US005645331A

United States Patent [19]

Eddy et al.

[11] Patent Number: 5,645,331

[45] Date of Patent: Jul. 8, 1997

[54] LOWER FRONT FOR WATER COOLERS, AND APPARATUS AND METHOD FOR RENOVATING WATER COOLERS

[75] Inventors: John W. Eddy, Riverside; Kelley S. Needham, Yorba Linda; Jeffrey L. Harlan, Corona, all of Calif.

[73] Assignee: Kel-Jac Engineering and Plastic Sales, Inc., Riverside, Calif.

[21] Appl. No.: 689,710

[22] Filed: Aug. 16, 1996

Related U.S. Application Data

[63] Continuation of Ser. No. 497,092, Jun. 30, 1995, abandoned, which is a continuation-in-part of Ser. No. 315,333, Sep. 30, 1994, Pat. No. 5,528,810.

[51] Int. Cl.[6] ..... A47B 45/00

[52] U.S. Cl. ..... 312/205; 312/204; 312/265.6; 312/257.1; 222/185.1

[58] Field of Search ..... 312/204, 205

[56] References Cited

U.S. PATENT DOCUMENTS

| | | | |
|---|---|---|---|
| 2,192,862 | 3/1940 | Eagley | 312/245.6 X |
| 3,040,848 | 6/1962 | Powell et al. | 312/257.1 X |
| 3,365,535 | 1/1968 | Wilk | 312/257.1 X |
| 3,915,530 | 10/1975 | Anderson et al. | 62/298 X |
| 4,153,313 | 5/1979 | Propst | 312/265.6 X |
| 4,600,148 | 7/1986 | Raymer et al. | D7/304 X |
| 4,804,877 | 2/1989 | Harwood | 312/137 |
| 5,176,435 | 1/1993 | Pipkens | 312/265.6 X |
| 5,385,273 | 1/1995 | Eddy et al. | 222/185.1 |
| 5,395,014 | 3/1995 | Burrows | 222/185.1 X |

FOREIGN PATENT DOCUMENTS

| | | | |
|---|---|---|---|
| 50246 | 4/1982 | European Pat. Off. | 312/265.6 |
| 302025 | 2/1989 | European Pat. Off. | 312/257.1 |

*Primary Examiner*—Peter M. Cuomo
*Assistant Examiner*—Rodney B. White
*Attorney, Agent, or Firm*—Richard L. Gausewitz

[57] ABSTRACT

A lower front for water coolers for reducing the expense and labor of renovating different brands of used water coolers. In one of its aspects, the apparatus comprises new front panel elements that are substantially identical to each other, and are shaped and adapted to replace corresponding used front panel elements on the used water coolers even though such used front panel elements, and related parts, are different from each other.

20 Claims, 4 Drawing Sheets

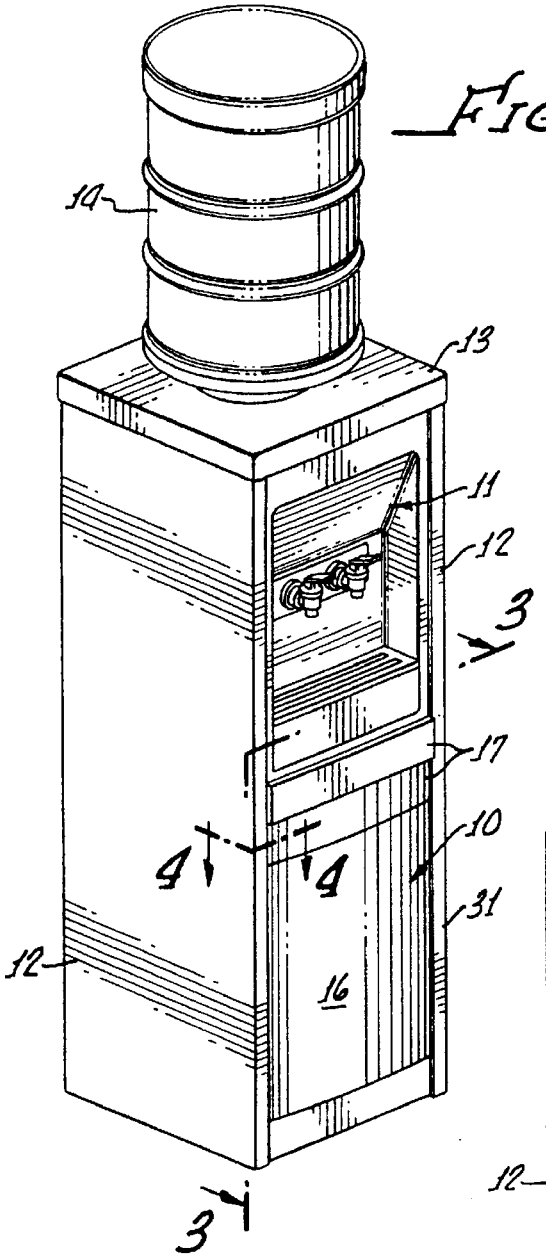
FIG. 1.
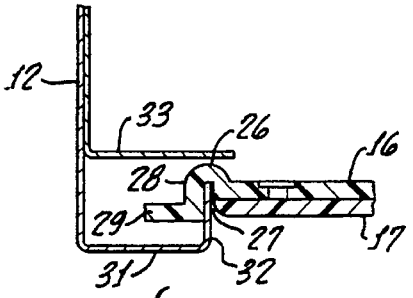
FIG. 4.
FIG. 3.
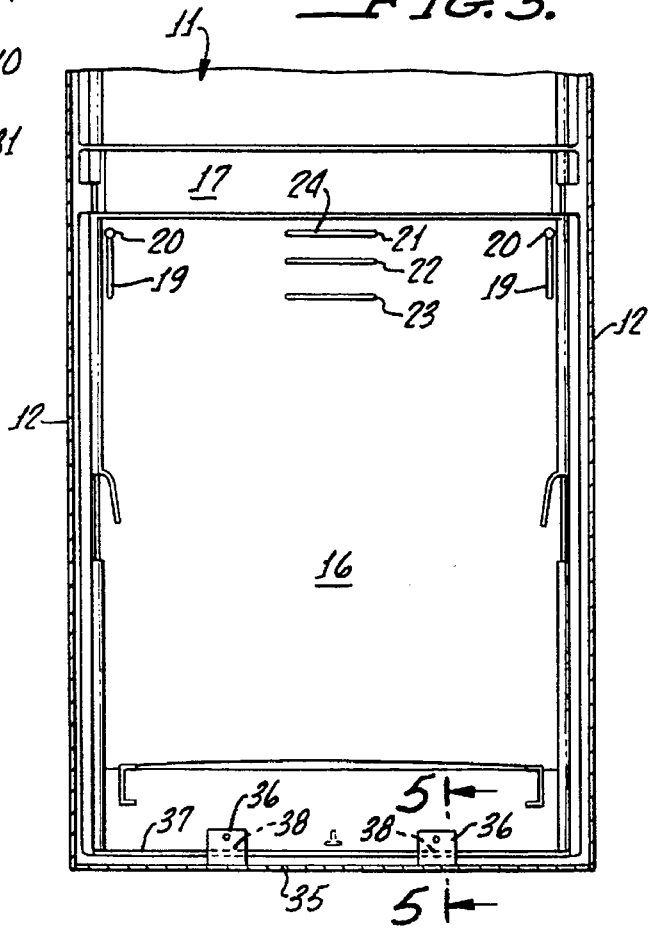
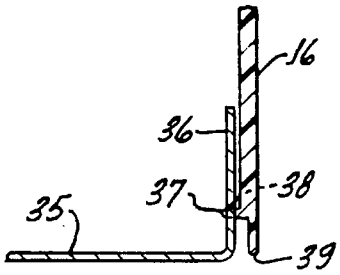
FIG. 5.

LOWER FRONT FOR WATER COOLERS, AND APPARATUS AND METHOD FOR RENOVATING WATER COOLERS

CROSS-REFERENCE TO RELATED APPLICATION

This is a continuation of application Ser. No. 08/497,092 filed on Jun. 30, 1995, now abandoned, which is a continuation-in-part of patent application Ser. No. 08/315,333, filed Sep. 30, 1994, now U.S. Pat. No. 5,528,810, issued Jun. 25, 1996.

BACKGROUND OF THE INVENTION

Large numbers of domestic water coolers are now present in homes and offices, etc., where they continually collect dust, grime, grease, scratches, etc. When a particular customer ceases using the cooler, or when such customer has been using the cooler so long that refurbishing is warranted, the cooler is picked up and taken to a central processing area where an assembly-line operation performs renovation (refurbishing.)

Each cover has an upper front and a lower front, the upper front being the portion through which the faucets extend, and the lower front being the portion extending between the upper front and the floor.

There are three major manufacturers of domestic water coolers. The cooler brand manufactured by each of the three is different from that manufactured by each of the others. In co-pending application, Ser. No. 08/315,333, filed Sep. 30, 1994, it was explained how it was important that a single new upper front be provided for all three brands during the renovation process. To provide a single lower front for all three brands would also be particularly difficult in view of the fact that the brands are characterized by different spacings, different frame constructions, and the absence of any faucets to hold the lower fronts in position. Despite these and other difficulties, it is very important that single lower fronts be provided for all three major brands of coolers.

It is pointed out that the concept of having single lower fronts for a plurality of brands is part of the below-described invention.

SUMMARY OF THE INVENTION

There has now been achieved a single lower front for all three of the major brands, and a method of mounting such lower front on all three brands in conjunction with the upper front described in the cited patent application.

The result of the single lower front (and associated method), particularly when combined with the upper front of the cited patent application, is literally a transformation of the three different brands of coolers into what seems to be, to the average purchaser or user, a single brand of cooler. This not only achieves the advantage of ease of renovation, in addition to the advantages of minimum storage of parts, and minimum difficulty of having parts readily available for assembly, but also achieves the advantage of causing truck delivery persons to not readily know which brand is which. It is thought by some in the industry that the preference of delivery persons for one brand over the others is an adverse factor.

In accordance with one aspect of the present invention, two lower front components are assembled with each other in partially overlapped condition, and are adapted to be adjusted relative to each other to three different predetermined positions in accordance with which of the three brands is being renovated.

In accordance with another aspect of the invention, a flexing/interlocking system is employed whereby the position for any of the three brands of coolers may be achieved in a few seconds without use of fasteners.

In accordance with another aspect of the invention, cam means are provided to effectively center the lower front in one brand of cooler despite the fact that the spacing between the sides of such brand is distinctly greater than the spacing between the edges of the lower front.

In accordance with another aspect of the invention, mounting strips or extrusions are provided to effectively assemble the lower front with one brand of cooler, just below the upper front thereof which is also assembled with such mounting strips or extrusions.

In accordance with another aspect of the invention, the elements indicated in the preceding paragraphs are extremely inexpensive and are caused to cooperate with elements already present on the water coolers, to maintain the cost of the renovation method (and associated apparatus) very low.

In accordance with another aspect of the invention, removable tabs are provided on the lower front, such tabs being manually broken off when one brand of cooler is being renovated—so as to permit adjustment of the two lower front elements for such one brand. When another brand is being renovated, the tabs effectively fill in gaps that would otherwise be present.

BRIEF DESCRIPTION OF THE DRAWINGS

FIG. 1 is an isometric view showing one brand of water cooler that has been renovated with the lower front of the invention—and also with the upper front described in the cited patent application;

FIG. 3 is a fragmentary sectional view on line 3—3 of FIG. 1, and which shows from the interior of the one brand of cooler the lower front associated with components of such one brand;

FIG. 4 is a fragmentary horizontal sectional view on line 4—4 of FIG. 1;

FIG. 5 is a horizontal sectional view on line 5—5 of FIG. 3;

DETAILED DESCRIPTION OF THE PREFERRED EMBODIMENTS

Figure 2:
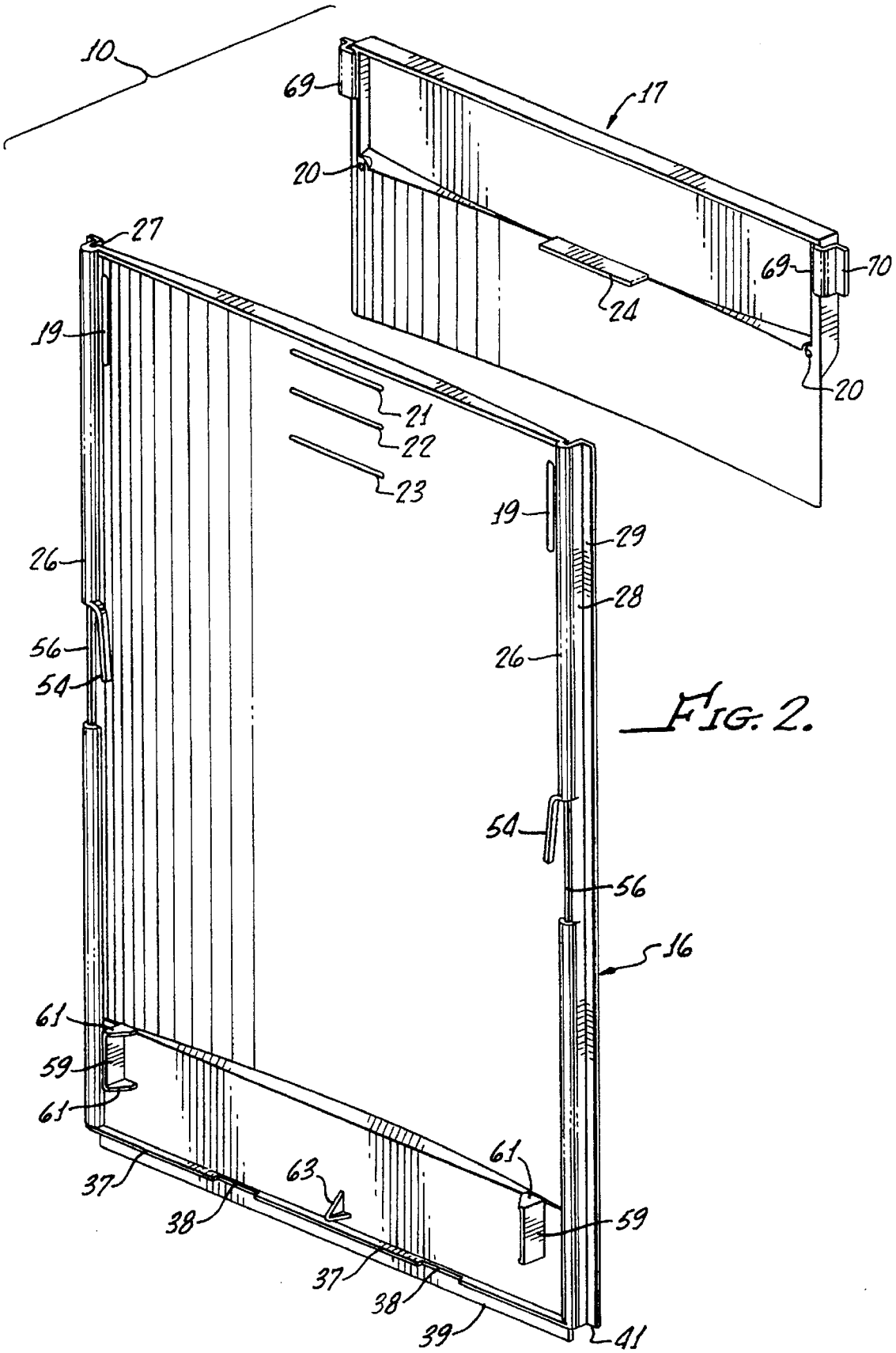
FIG. 2 is an exploded isometric view showing the inside surface and components of one of the lower fronts.

The above-cited U.S. patent application Ser. No. 08/315,333, filed Sep. 30, 1994, is hereby incorporated by reference herein.

The words "water cooler" and "cooler" denote, in the present specification and claims, various conventional drinking water, etc., apparatus. For example, they include apparatus that dispenses bottled water either at room temperature or refrigerated, and/or R.O. water, and/or hot water for cooking and other purposes.

Referring to FIG. 1, the illustrated conventional cooler is one of the three major brands indicated above. It has—after completion of a renovation by means of the present invention—a lower front 10, an upper front 11 constructed and mounted as described in the cited patent application, side panels 12, a top 13, and a water bottle 14. It also has frame and corner elements described subsequently.

All of the elements described herein are either mirror images relative to each other about a vertical central plane that is parallel to the opposed sides 12 of the cooler, or is are themselves located in such plane. The same statement applies to the embodiments of FIGS. 6 et seq. and 11 et seq.

Referring to FIG. 2, the lower front 10 shown therein has two injection-molded synthetic resin panels 16, 17. In the illustrated embodiment, panel 16 is the bottom panel and is much larger than panel 17 which is the top panel. Each panel is rectangular and the panels overlap each other at the top end of panel 16. Means are provided to adjustably associate the panels with each other, so that the length (vertical dimension) of lower front 10 may be changed in a second or two to a desired predetermined length, depending on what brand of cooler is being renovated.

There is a vertical slot 19 at the upper corner of each bottom panel 16. Such slot and the remainder of the adjustment mechanism is not visible to the user of the cooler, one reason being that the upper end of bottom panel 16 is inside of the lower portion of top panel 17. A screw 20 extends freely through each slot 19 and is threaded into top panel 17, in such relationship that the head of the screw keeps the panels closely adjacent each other but still freely movable relative to each other.

To both lock the bottom and top panels in any of three adjusted positions relative to each other, and also to help keep the panels properly assembled and oriented as well as to prevent twisting of the panels relative to each other despite the fact that only one screw 20 is employed on each side, there are three horizontal slots 21–23, molded in bottom panel 16, centrally thereof in predetermined vertically spaced relationship relative to each other. A single horizontal lock bar 24, which is molded at the central region of top panel 17 and projects rearwardly therefrom for selective insertion into any one of the slots 21–23, is provided.

Preferably, the lock bar 24 and its associated three slots are quite long so as to provide stability, an exemplary length being about two inches. Initials indicating the three different brands of coolers are molded into the interior surface of bottom panel 16, so that there can be no doubt as to what is the correct adjusted position for the particular brand of cooler.

To shift from any adjusted position of the top and bottom panels to any other adjusted position thereof, the operator engages the central-top portion of bottom panel 16 and simultaneously engages the exposed adjacent portion of top panel 17, and applies gentle opposing forces that create a flexing action causing lock bar 24 to move out of whatever slot it is in. The operator then shifts the panels longitudinally relative to each other for a short distance and permits the natural resilience of the synthetic resin to cause resumption of the normal (free) conditions of the panels 16, 17, so that the lock bar 24 automatically (in response to such resumption of free condition) inserts itself into the desired slot 21, 22, or 23. The screws 20 and associated slots 19 do not inhibit this longitudinal movement, but they still keep the panels assembled with each other. As above indicated, the combination of the single screws 20 and the relatively long bar 24 prevent the panel edges from being out of parallelism to each other.

As best shown in FIGS. 2 and 4, bottom panel 16 is wider than is top panel 17, and is shaped interiorly with a hairpin-"bent" bead 26. The outer side of the bead is a narrow groove 27. The bead has an outer wall 28 that is much wider than is the bead portion (bead wall) immediately adjacent the body of bottom panel 16. Such outer wall 28 extends forwardly a distance sufficiently far that its forward edge is further forward than is the forward face of top panel 17 (reference being made to FIG. 4). At such forward edge, there is an outwardly extending flange 29, the purpose of which is described subsequently.

Referring again to FIG. 4, each forward corner of the body of the cooler shown in FIG. 1 has its side panel 12 bent at a right angle so as to form a forward face 31. Face 31, in turn, is bent rearwardly at a right angle to form a rearwardly-extending flange 32. The inner edge of such flange 32 is spaced sufficiently far from an interior member 33 of the body of the cooler shown in FIG. 1 that the bead 26 (at its region inwardly of the bottom of groove 27) has sufficient room to be present between the inner edge of flange 32 and the interior member 33.

Grooves 27 are spaced apart from each other a distance corresponding to the distance between the rearwardly extending flanges 32 on opposite sides of the front portion of the cooler (FIG. 1).

To mount the lower front 10 in the water cooler brand of FIG. 1, the original upper front and lower front are removed (after removing the faucets or spigots), and the top 13 is removed. Then, a person looking down on the top corners of the cooler would see a view like that of FIG. 4, it being pointed out that the top portion of interior member 33 does not extend to the extreme top of the cooler but has its upper region generally at the level of the spigots.

The person renovating the cooler quickly performs the above-indicated flexing of the top and bottom panels so as to cause lock bar 24 to be in the uppermost slot 21 (this having the above-mentioned initials or mark (not shown) indicating that slot 21 corresponds to the particular cooler shown in FIG. 1).

The person then mates the grooves 27 with the upper edges of flanges 32, and slides the lower front 10 all the way to the bottom of the cooler (to the position shown in FIG. 1). As soon as the bead 26 reaches the upper region of the interior member 33, the bead fits between flange 32 and interior member 33; interior member 33 then effectively prevents the lower front 10 from being pushed inwardly.

The constructions of the various members described subsequently—relative to other bands of coolers—are such that they do not interfere with the described downward sliding motion of lower front 10 relative to the cooler shown in FIG. 1.

Referring to FIGS. 3 and 5, the bottom wall of the cooler of FIG. 1 is numbered 35, and has bent upwardly therefrom two metal tabs 36. There is a horizontal bead or ridge 37 molded across the lower inner face of bottom panel 16, as best shown in FIG. 2; this bead is provided with interrupted portions (gaps) 38, the locations of which correspond to the locations of the tabs 36. Thus, tabs 36 are not engaged by bead or ridge 37 (the function of which is described subsequently), which makes it possible for the extreme lower edge 39 (FIG. 5) of bottom panel 16 to be at the same elevation as that of bottom wall 35 of the cooler (there being a thin support pad, not shown). The bottom panel 16 is supported against further downward movement by corner portions 41 (FIG. 2) of the bottom panel, which corner portions seat on unshown horizontal tabs at the extreme front interior portions of the cooler of FIG. 1.

Upper front 11 is then mounted as described in the cited patent application, and top 13 is mounted over the top of the cooler. The spigots are remounted, so that the cooler is renovated or refurbished. It is to be understood that the sides 12 are not merely reused, but are at least painted and may also be replaced by plastic elements.

It is emphasized that because of the particular degree of extension of lower front 10, caused by the fact that lock bar 24 is in the predetermined slot 21, the bottom of upper front 12 seats on the top of lower front 10, and the upper and lower fronts fill the entire space at the forward side of the cooler of FIG. 1.

Embodiment of FIGS. 6–10

FIGS. 6–10 relate to the lower portion of a different one of the above-indicated three main brands of coolers, it being understood that there is also an unshown upper front, top, etc., as described in the cited patent application.

Figure 6:
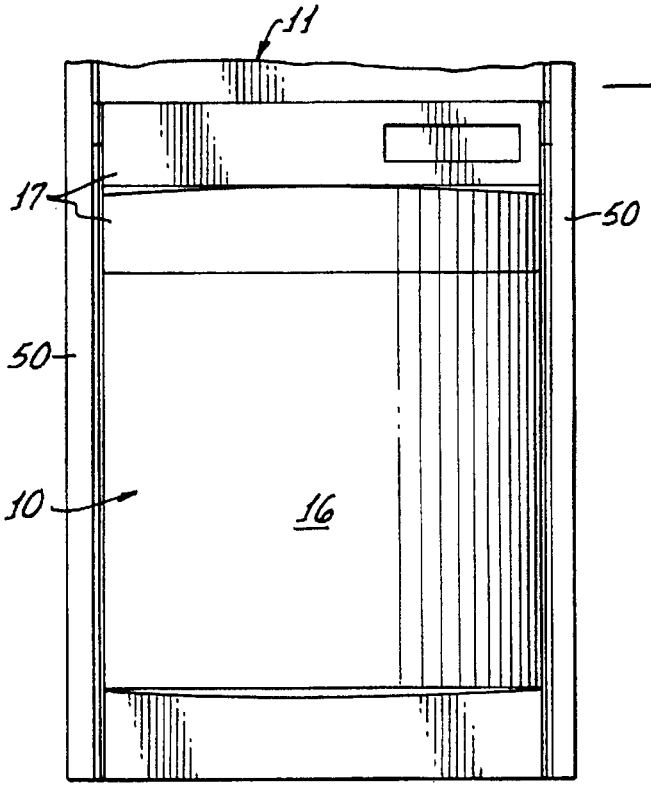
FIG. 6 is a front elevational view showing the lower front of the present invention as assembled on the lower portion of a second brand of cooler.
Figure 7:
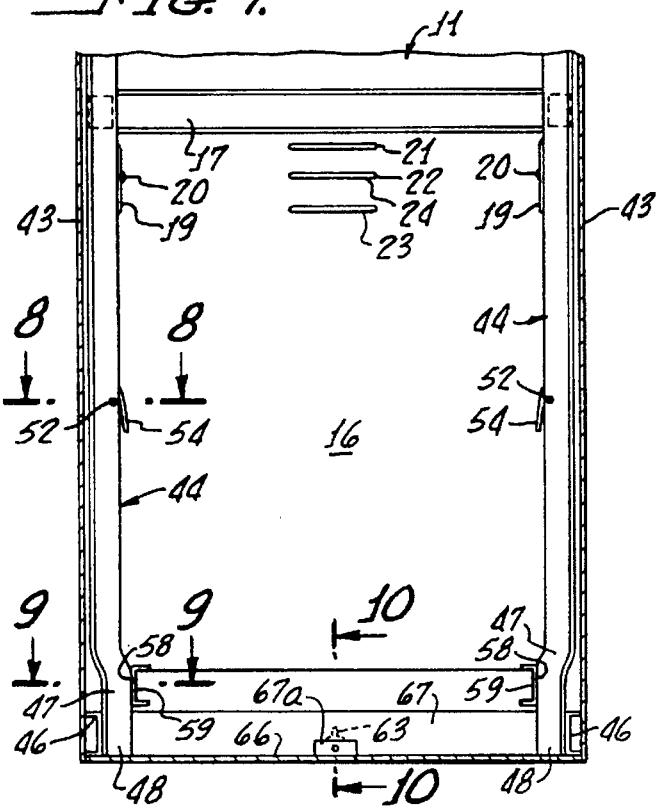
FIG. 7 corresponds to FIG. 6 but shows the combination lower front and second brand of cooler from the interior of the cooler.

The cooler brand of FIGS. 6–10 has side panels 43 secured to a frame that comprises vertical angle bars 44 and horizontal bars 46, the latter extending forwardly and rearwardly at the extreme lower portions of the side panels. The lower ends of angle bars 44 bend inwardly and downwardly at 47, so as to clear the bars 46. Thus, there is the inwardly-downwardly bent portion 47 and a vertical portion 48 therebeneath, as shown in FIG. 7.

Figure 8:
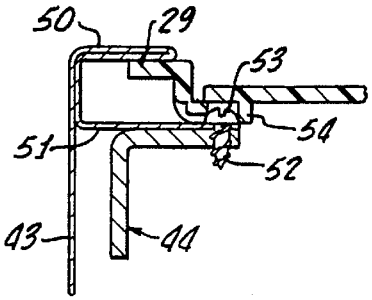
FIGS. 8, 9 and 10 are respectively fragmentary sectional views on lines 8—8, 9—9, and 10—10 of FIG. 7.
Figure 9:
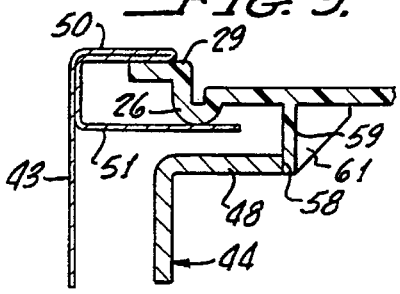

As best shown in FIGS. 8 and 9, side panels 43 bend into front edge portions 50. These are return-bent both at the front edge portions and at the adjacent regions of the side panels, as illustrated. Each return-bent portion bends away from the main body of the side panel to form a large inwardly-extending flange 51 that is parallel to and spaced inwardly (rearwardly) from front edge portion 50.

Screws are employed to secure angle bars 44 to the large flanges 51 of side panels 43. One of these screws is indicated at 52 in FIGS. 7 and 8. It has a head 53 disposed on the forward side of flange 51, such head being preferably what is known in the art as a "pan head".

The lower portion 48 of each angle bar 44 not only extends inwardly (FIG. 7) but rearwardly (FIG. 9). Thus, portion 48 is not secured to flange 51; it is secured to other portions of the frame.

There are four cams (cam mechanisms) that effectively center and maintain vertical the bottom panel 16 and thus the entire lower front 10. In the case of two mirror-image upper cams, the cam portion of the mechanism is part of lower front 10, whereas the cam follower portion is part of the existing cooler (except that a different type of screw 52/53 is employed). In the case of two mirror-image lower cam mechanisms, the cam portion is part of the existing cooler, whereas the cam follower portion is part of lower front 10.

Each mirror-image upper cam includes as the cam follower the head 53 (FIG. 8) of the screw 52. It includes as the cam a downwardly and inwardly-inclined elongate narrow cam element 54, best shown in FIG. 2. Furthermore, the portions of bead 26 adjacent and below cam element 54 are not present, there being instead only a narrow element 56 (FIG. 2) that is vertical and that replaces the "bottom" portion of the groove 27.

The remaining two mirror-image cams include the inner edges of angle bars 44 at the downwardly bent portions 47 thereof. They further include, on each side, a cam follower surface plate 59 that is molded into the interior side of bottom panel 16 (FIG. 2) and reinforced by webs 61 (FIG. 2).

Referring to FIGS. 8 and 9, the spacing between the forward surface of plastic flange 29 at the edge of bottom panel 16, and the ridge or rearmost portion of bead 26, is caused to be just slightly less than the distance between the opposing faces of front edge portion 50 of the side panel and large flange 51 thereof. Thus, as shown in both of FIGS. 8 and 9, the bottom panel 16 and thus the entire lower front 10 may not move substantially in a forward-rearward direction. Thus, the next-described cam actions occur in the absence of forward or rearward shifting of the bottom panel 16, which shifting could otherwise result in disengagement between cams and cam followers.

When bottom panel 16 is mounted beginning at the upper region of the cooler (the upper front 11 being absent), with the panel edges inserted between elements 50, 51 as shown in FIG. 9, subsequent downward movement of the panel 16 causes the bottom ends of elongate cam elements 54 to pass inwardly of heads 53 (FIG. 8) of screws 52. Substantially simultaneously, the same downward movement causes the outer surfaces of cam follower surface plates 59 to engage inner edges 58 of inclined or bent portions 47 of angle bars 44. There results centering movements at all four of the cam elements until when the bottom panel 16 is in the fully-mounted position of FIG. 7, the bottom panel 16 being fully centered. At that time, the heads 53 of cam follower screws 52 are nested between elements 54, 56 (FIG. 2), and the surface plates 59 are retained effectively between edges 58 of the vertical bottom portions 48 of angle bars 44.

Accordingly, and despite the fact that the cooler shown in FIGS. 6 and 7 is excessively wide for the lower front 10, the lower front is properly centered and held therein against both sideways and forward/rearward movements.

Figure 10:
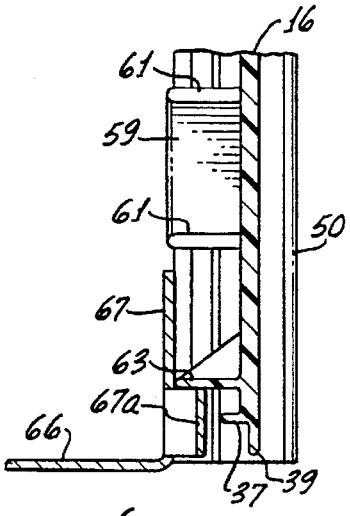
Figure 11:
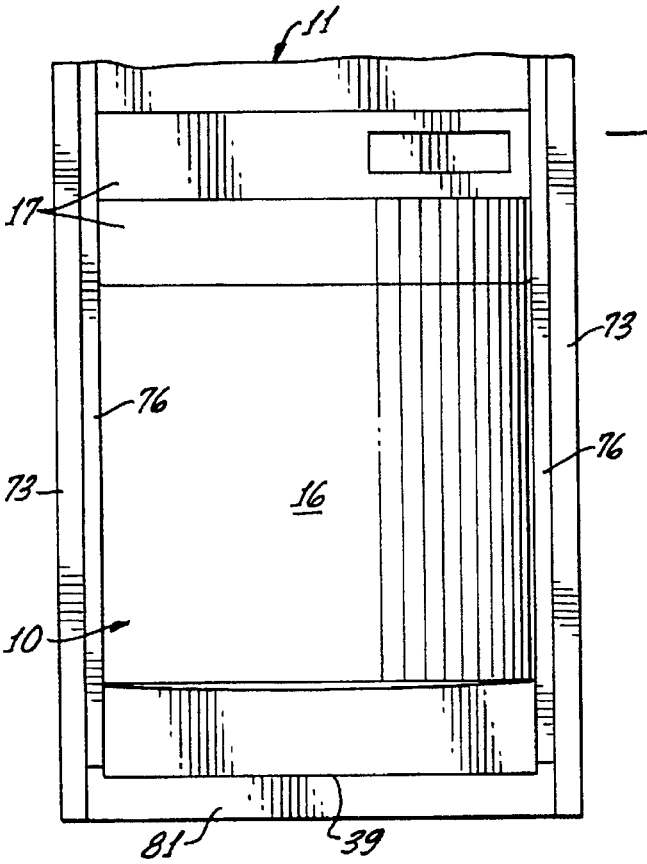
FIG. 11 is a front elevational view showing the present lower front assembled with the lower portion of a third brand of cooler.
Figure 13:
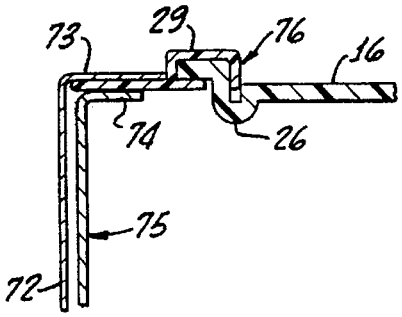
FIGS. 13 and 14 are respectively fragmentary sectional views on lines 13—13 and 14—14 of FIG. 12.
Figure 12:
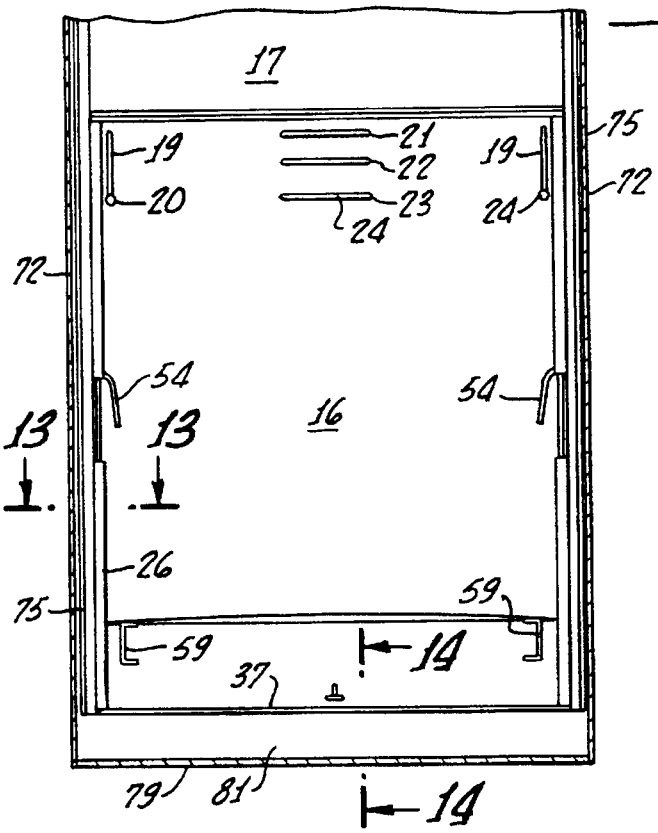
FIG. 12 corresponds to FIG. 11 but shows the assembled lower front and third cooler brand as viewed form the interior of the cooler.

It is ensured that there will be no excessive downward movement of bottom panel 16, namely, the entire lower front 10, because a stop element 63 that projects from panel 16 engages a bottom portion of the cooler as shown in FIG. 10. (The stop element is also well shown in FIG. 2.) The stop element 63 engages the upper side of a bent metal element **67*a*. The metal bottom 66 of the cooler is bent up to form a front wall 67 having a short vertical dimension. The bottom-central portion of such front wall 67 is pierced and bent to form a forwardly-curving element 67*a* on which stop 63 sits, thereby ensuring against further downward movement of the bottom panel 16**.

The described downward shifting of bottom panel 16 is not effected until after the vertical dimension of the lower front is adjusted to the exact desired length. Such length is such that after the upper front is mounted, there will be no gap between them (the upper front and the lower front). This is done by the above-described relative flexing of the elements shown in FIG. 2, followed by registering of lock bar 24 with the middle slot 22 (such slot being marked to indicate that it is the proper one for the cooler brand of FIGS. 6–10).

There are bead extensions and associated outwardly-extending flanges at the upper corners of upper panel 17, as best shown in FIG. 2. The bead extensions are indicated as 69 in FIG. 2, and they are integral with outwardly-extending flanges 70. Bead extensions 69 and flanges 70 are respectively registered with beads 26 and flanges 29. Furthermore, the lengths of elements 69, 70 and the positions thereof are such that when lock bar 24 is inserted into the central slot 22, as it is for the present embodiment (present cooler brand), the lower ends of elements 69, 70 are closely adjacent the upper ends of elements 26, 29, respectively.

It follows that the beads 26 and flanges 29 are, in effect, extended upwardly in the present embodiment by lengths equal to the vertical dimensions of bead extensions 69 and flanges 70. This is significant because in the absence of these elements 69, 70, there would be gaps above lower front 10 at the outer edge portions thereof. With the described construction, there are no substantial gaps, and the upper front 11 may then be inserted (as described in the cited patent application) and seated on the upper end of the lower front.

As was the case relative to the first brand of cooler (FIGS. 1 and 3–5), the components of the lower front 10 are made such that nothing on the lower front will interfere with operation of the lower front relative either to the first brand or the below-described third brand. Stated otherwise, no component of the lower front interferes with operation thereof relative to any brand; each component is either functioning relative to a particular brand or is not interfering with such functioning.

Embodiment Relative to FIGS. 11–14

Referring next to FIGS. 11–14, the invention is shown as employed relative to the remaining one of the three different major brands of coolers. For this brand, the bead extensions 69 and flanges 70 are manually broken off, which makes it possible to overlap the top panel 17 to its maximum degree of overlapping relative to bottom panel 16. Such maximum overlapping is effected by the above-described flexing of the panels, following which lock bar 24 is inserted into the lowest slot 23 (which is marked for the particular brand).

The cooler brand of FIGS. 11–14 has side panels 72 that are bent to form forward faces 73. Interior supporting elements of the cooler of FIGS. 11–14, namely, channels, are secured to the side panels 72 by screws and are spaced a short distance away from such side panels. Accordingly, a gap is formed between each forward face 73 and the associated flange 74 of each channel 75.

An elongate synthetic resin extrusion, numbered 76, is provided on each side of the device for almost the full vertical height of the cooler. The extrusion is substantially the same as the one shown and described in the cited patent application. It wraps around the flange 29 (FIG. 13), extends into the groove 27 (FIG. 2) in the bead 26, and extends into the indicated gap between forward face 73 and flange 74.

One way to mount the lower front 10 is to first mount the upper front 11 by means of the extrusions 76, sliding the extrusions down on each vertical side of the upper front 11 until the lower ends of the extrusions are a short distance below the bottom edge of the upper front. For example, ¾ inch below such edge. The upper edge of the previously adjusted (by elements 23, 24) lower front 10 is then inserted upwardly beneath the downwardly-protruding bottom ends of the extrusions. The lower front 10 is then caused to be in the plane of the front of the cooler, with the bottom end of the lower front 10 resting on a support as described below relative to FIG. 14. Extrusions 76 are then inserted downwardly additional distances until they reach their positions adjacent the upper edge of the wall described relative to FIG. 14.

Figure 14:
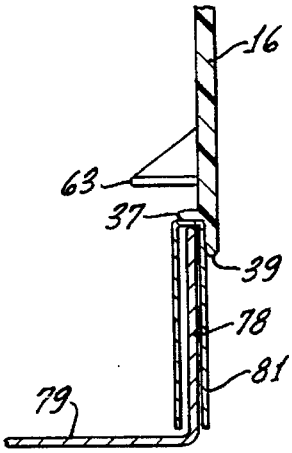

The wall shown in FIG. 14 is numbered 78, being a vertical flange that is bent upwardly from the bottom 79 of the cooler. It has a decorative hairpin-section element 81 mounted thereover. Seated on the upper edge of element 81 is the above-described horizontal bead or ridge 37, best shown in FIG. 2. Such bead or ridge is somewhat above the extreme bottom edge 39 of bottom panel 16, so that there is no possible gap.

Thus, the upper and lower fronts are both mounted quickly and easily, to complete the renovation process relative to the front of the cooler. As above stated, the sides may be otherwise renovated.

Because of the described positions of bottom panel 16 and top panel 17, when lock bar 24 is in bottom slot 23, the upper front and lower front have correct dimensions to fill the front of the cooler and there are no gaps.

The foregoing detailed description is to be clearly understood as given by way of illustration and example only, the spirit and scope of this invention being limited solely by the appended claims.

What is claimed is:

1. A front for a domestic water cooler, which comprises:

(a) a first panel having a top edge, a bottom edge, and side edges, (b) a second panel having a top edge, a bottom edge, and side edges, said first and second panels being partially overlapped relative to each other in such manner that said bottom edge of one of said panels overlaps said top edge of the other of said panels, (c) means to mount said first and second panels in partially overlapped condition relative to each other, with different degrees of overlapping, and (d) means to mount said panels on the front of a domestic water cooler.

2. The invention according to claim 1, in which said first and second panels are both molded of synthetic resin, and in which one of said panels is much different in size from the other of said panels.

3. The invention according to claim 1, in which said front is adapted to be mounted selectively on at least two different brands of water coolers, in which said means to mount said panels in partially overlapped condition, with different degrees of overlapping, comprises means to hold said panels in at least two predetermined partially overlapped conditions, said predetermined conditions being determined by the brands of water coolers on which said panels are mounted.

4. The invention according to claim 3, in which said means to hold said panels comprises at least two openings in one of said panels, and a protrusion on the other of said panels, said protrusion being adapted to be inserted into and remain in each of said openings at different times.

5. The invention according to claim 4, in which at least one of said panels is adapted to be flexed in such manner as to withdraw said protrusion from any one of said openings.

6. The invention according to claim 5, in which said one panel has a free condition such that said protrusion will remain in either of said openings.

7. The invention according to claim 6, in which each of said openings is an elongate transverse slot and in which said protrusion is an elongate transverse lock bar shaped to fit in said slot.

8. The invention according to claim 4, in which said means to mount said first and second panels in partially overlapped condition includes longitudinal slots in one of said panels, at opposite edge portions thereof, and further includes means connected to the other of said panels and extended through said longitudinal slots.

9. The invention according to claim 8, in which said means extended through said longitudinal slots is a single screw in each longitudinal slot.

10. The invention according to claim 1, in which said means to mount said panels on the front of a domestic water cooler comprises cam means to associate said panels with side portions of said domestic water cooler.

11. The invention according to claim 1, in which said means to mount said panels on the front of a domestic water cooler comprises groove means on said panels to receive edge portions of said domestic water cooler.

12. The invention according to claim 1, in which said means to mount said panels on the front of a domestic water cooler comprises elongate extrusions shaped to be mounted vertically and to lock edge portions of said panels to edge portions of said domestic water cooler.

13. The invention according to claim 1, in which said front is adapted to be mounted selectively on at least three different brands of water coolers, in which said means to mount said panels on the front of a domestic water cooler comprises cam means to associate said panels with side portions of a domestic water cooler, in which said means to mount said panels on the front of a domestic water cooler comprises groove means on said panels to receive edge portions of a domestic water cooler, and in which said means to mount said panels on the front of a domestic water cooler comprises elongate extrusions shaped to be mounted vertically and to lock edge portions of said panels to edge portions of a domestic water cooler, and in which only a particular one of said cam means, groove means and extrusions is used at a time, said particular one depending on the brand of water cooler on which said front is being mounted.

14. The invention according to claim 1, in which breakaway tabs are provided on one of said panels.

15. The invention according to claim 1, in which said front is combined with a domestic water cooler.

16. A lower front for a domestic water cooler, comprising:

(a) panel means, sized and shaped to substantially cover the lower front of at least two brands of domestic water coolers, and (b) means to mount said panel means selectively on at least two brands of domestic water coolers, wherein said mounting means comprising means to mount said panel means on the front of a domestic water cooler and further comprising cam means to center said panel means with respect to side portions of a domestic water cooler.

17. The invention according to claim 16, in which said cam means comprises downwardly and inwardly-inclined cam edges on said panel means, and further comprises cam-follower elements on said cooler.

18. The invention according to claim 16, in which said cam means comprises downwardly and inwardly-inclined portions of said cooler, and cam-follower elements on said panel means.

19. The invention according to claim 14, in which said cam means comprises downwardly and inwardly-inclined cams on said panel means, and further comprises cam-follower elements on said cooler, and in which said cam means further comprises downwardly and inwardly-inclined portions of said cooler, and cam-follower elements on said panel means.

20. A lower front for a domestic water cooler, comprising:

(a) panel means, sized and shaped to substantially cover the lower front portion of at least three brands of domestic water coolers, and (b) means to mount said panel means selectively on at least said three brands of domestic water coolers, said means to mount said panel means on the lower front portion of said domestic water coolers comprising cam means to associate said panel means with side portions of a domestic water cooler, said means to mount said panel means on the lower front portion of a domestic water cooler also comprising groove means on said panel means to receive edge portions of said domestic water cooler, and said means to mount said panel means on the lower front portion of a domestic water cooler also comprising elongate extrusions shaped to be mounted vertically and to lock edge portions of said panel means to edge portions of a domestic water cooler, and in which only one of said cam means, groove means and extrusions is used at a time, the particular one depending on the brand of water cooler on which said lower front is being mounted.

* * * * *